US012252316B2

(12) United States Patent
Pezenti et al.

(10) Patent No.: US 12,252,316 B2
(45) Date of Patent: Mar. 18, 2025

(54) BUCKET COVER WITH ATTACHED STICK

(71) Applicant: DOMINUS QUIMICA LTDA, Jandaia do Sul (BR)

(72) Inventors: Alysson Rodrigo Pezenti, Mandaguari (BR); Victor Hugo Silva Simão, Jandaia do Sul (BR)

(73) Assignee: Dominus Quimica LTDA, Jandaia do Sul (BR)

( * ) Notice: Subject to any disclaimer, the term of this patent is extended or adjusted under 35 U.S.C. 154(b) by 52 days.

(21) Appl. No.: 18/324,488

(22) Filed: May 26, 2023

(65) Prior Publication Data

US 2023/0399154 A1 Dec. 14, 2023

(30) Foreign Application Priority Data

Jun. 9, 2022 (BR) ..... 102022011345-9

(51) Int. Cl.
*B65D 51/24* (2006.01)
*B65D 43/02* (2006.01)

(52) U.S. Cl.
CPC ..... *B65D 51/24* (2013.01); *B65D 43/02* (2013.01); *B65D 2555/00* (2013.01)

(58) Field of Classification Search
CPC ..... B65D 51/24; B65D 43/02; B65D 2555/00
USPC ..... 220/212.5, 521
See application file for complete search history.

(56) References Cited

U.S. PATENT DOCUMENTS 3,679,093 A * 7/1972 Chang ..... A47G 19/03 229/125.05
4,036,392 A * 7/1977 Martin ..... B65D 77/28 206/217
5,197,623 A * 3/1993 Wang ..... B65D 51/246 206/542
6,228,324 B1 * 5/2001 Hasegawa ..... A61L 2/208 604/199
8,240,468 B2 * 8/2012 Wilkinson ..... A61B 5/15003 206/363
8,322,548 B2 * 12/2012 Pedersen ..... B65D 41/0485 215/218
10,124,930 B2 * 11/2018 Sessions ..... B65D 25/44
10,633,155 B2 * 4/2020 Sedgwick ..... B65D 51/246
10,813,433 B2 * 10/2020 Thorpe ..... A45D 33/26
11,840,384 B2 * 12/2023 Simakovsky ..... B65D 51/32
2006/0180593 A1 * 8/2006 White ..... A47G 21/182 220/705
2007/0000933 A1 * 1/2007 Wang ..... A47G 19/2266 220/709
2012/0061409 A1 * 3/2012 Fioritto ..... B65D 77/286 220/710

FOREIGN PATENT DOCUMENTS

BR 202019024727-0 11/2010
BR MU8900540-6 6/2021

* cited by examiner

*Primary Examiner* — James N Smalley

(74) *Attorney, Agent, or Firm* — LaMorte & Associates PC

(57) ABSTRACT

A bucket lid designed with the purpose of making available to users a built-in stick in a certain space integrated in the lid itself. The stick is subsequently used in the homogenization of the product stored inside the bucket. The stick is preferably made of polymeric material and can be telescopic to reach the bottom of the bucket during mixing, optionally including a radially inserted ring that facilitates its removal from the central recess and the semi-circular pressure fittings existing in the lid.

3 Claims, 4 Drawing Sheets

FIG. 3
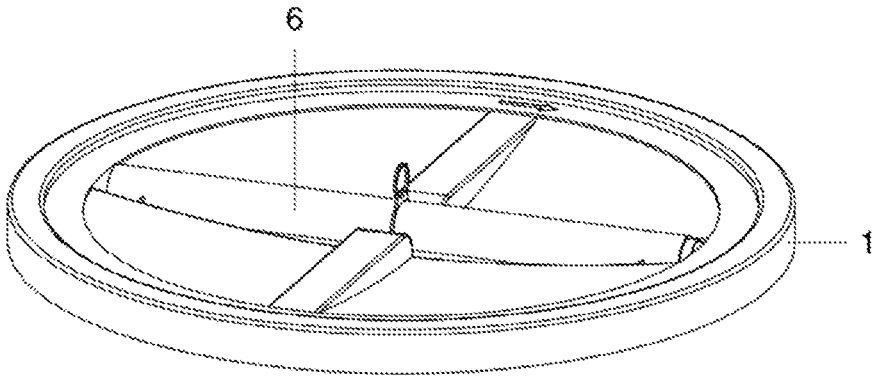
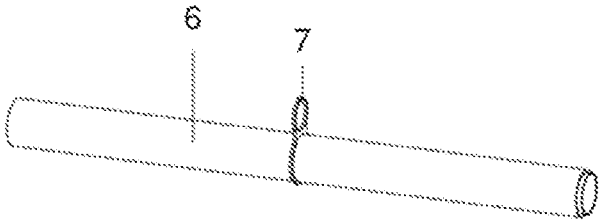
FIG 4
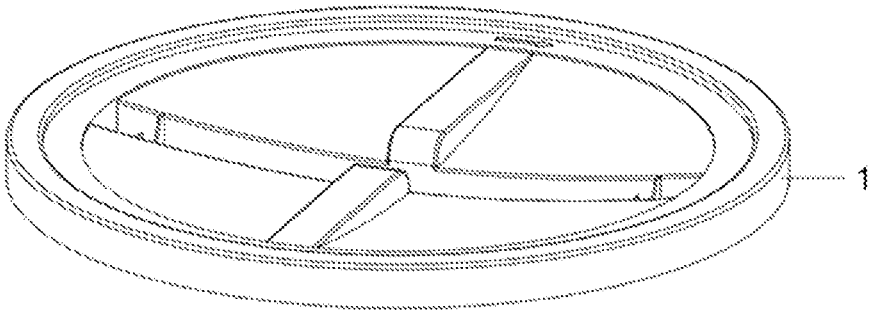
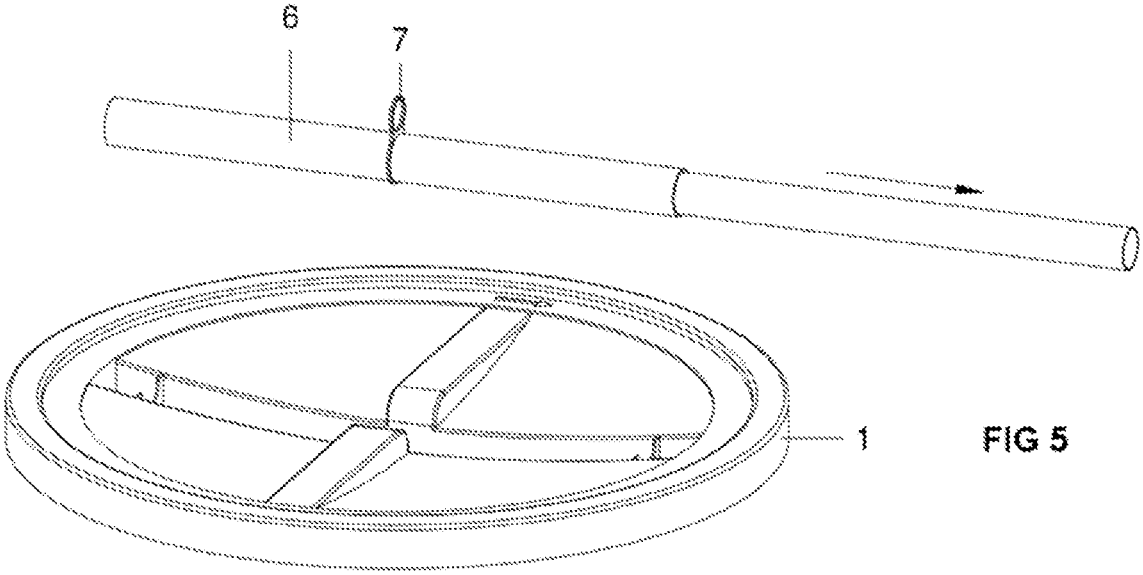
FIG 5

BUCKET COVER WITH ATTACHED STICK

FIELD OF INVENTION

The present invention is in the food, chemical, pharmaceutical or agribusiness sectors and refers to a differentiated bucket lid, which was designed with the purpose of making available to users a built-in stick in a certain space integrated in the lid itself. The stick is subsequently used in the homogenization of the product stored inside the bucket.

BACKGROUND OF THE INVENTION

There are currently numerous standards of buckets on the market for the storage of liquid or solid products, and the respective lids of these buckets are inserted by pressure or threading. Because they have recesses, the lids assist in the process of stacking the buckets, with the base of the bucket fitting perfectly onto the recess of the lid belonging to the bucket below.

However, depending on the type of product stored, it is necessary to homogenize the liquid after opening the bucket and before using the product. In most cases, the user adopts as a tool any object that acquires the function of a stick, whether it is a piece of wood, plastic or metal, often spending time to find an object capable of serving this need.

Referring to the state of the art regarding patent registrations, no documents were found that anticipate the proposal of the present invention, in whole or in part, however, the documents with numbers MU 8900540-6 and BR 202019024727-0 were found, which precisely describe objects admitted in the state of the art and explained previously, such as a plastic bucket with a threaded lid and constructive arrangement applied in a multi-use bucket that is stackable and has a lid, successively.

The plastic bucket with threadable lid described in the first document number MU 8900540-6 claims it has a fin (3) just below the threads belonging to the bucket (6), which fits in the concavity of the lid (2), locking both elements.

The constructive arrangement applied in a multi-use, stackable bucket with lid under registration BR 20 2019 024727-0 requires a conical-shaped bucket (1) equipped with a handle (2) and an upper lid (3) provided with a central circular recess (4) whose diameter is slightly larger than the diameter of the base of said bucket (1), thus allowing the fitting of another bucket, making it stackable.

Observing the gap existing in the current packaging market, mainly in buckets storing chemical compounds dependent on homogenization before being used, the present inventive activity aims to provide a new lid pattern developed to pack a removable rod or rod used later in the product mixture, in addition to having the fixing elements of the stick at the packaging location.

DESCRIPTION OF THE DRAWINGS

The following invention will be described in greater detail, by way of non-limiting example, with reference to its preferred realization illustrated in the images below, in which:

FIG. 3 shows the telescopic stick inserted into the cover in isometric view;

FIG. 4 shows the removal of the stick from the cover and its expansion in isometric view;

FIG. 5 shows the removal of the stick from the cover and its expansion in isometric view;

DETAILED DESCRIPTION OF THE INVENTION

Figure 1:
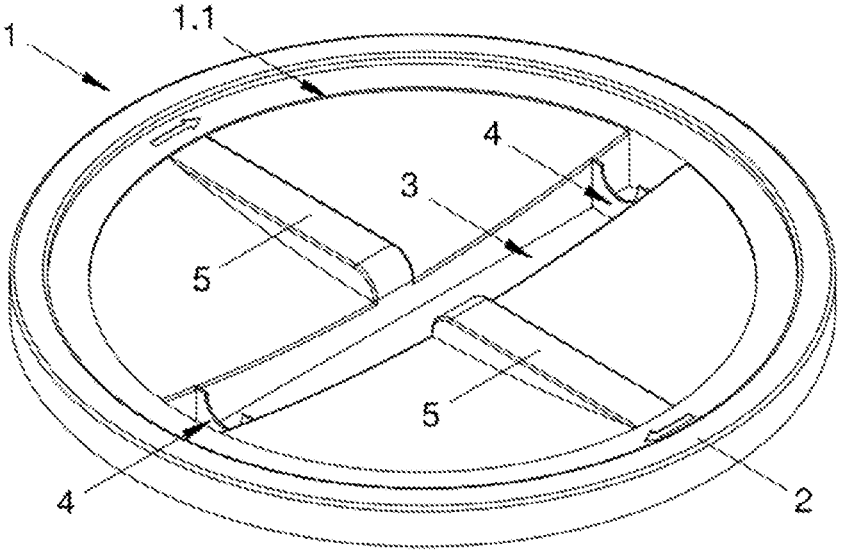
FIG. 1 shows the preferred configuration of the bucket lid in isometric view.
Figure 2:
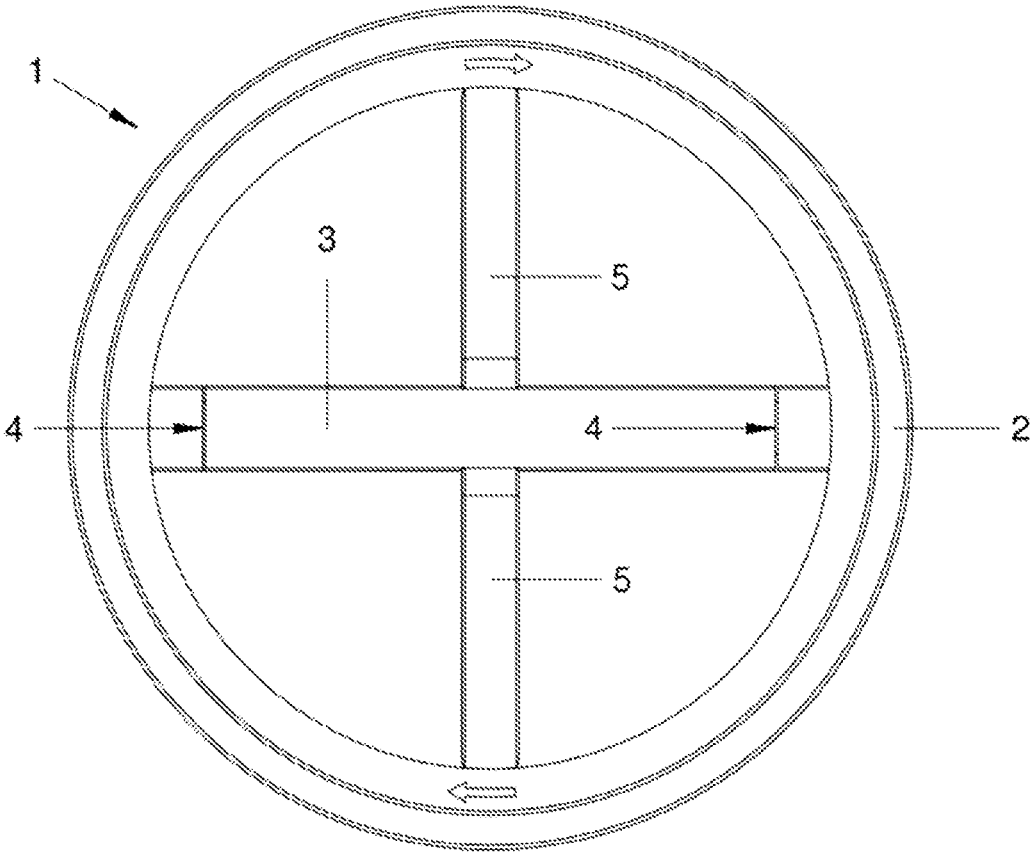
FIG. 2 shows the upper view of the arrangement of the item called the central recess on the cover.

According to FIGS. 1 and 2, the bucket cover (1) has a perimeter edge (2), which allows the stacking of other buckets as well as the other covers, but the novelty is in the central recess (3) that extends around 80% compared to the diameter of the cover, having at points near the ends of the aforementioned central recess (3) supports with semi-circular pressure fittings (4). Perpendicular to the longitudinal walls of the central recess (3) are the lid handles formed by shoulders (5), which start exactly on the longitudinal walls and end at the inner edge (1.1) of the lid (1).

The rod or stick (6) introduced into the central recess (3) (illustrated in FIG. 3) and properly fixed in the semi-circular pressure fittings (4) is preferably made of polymeric material and can be telescopic (represented in FIGS. 4 and 5) in order to reach the bottom of the bucket during mixing, optionally having a radially inserted ring (7) that facilitates its removal from the recess.

Figure 6:
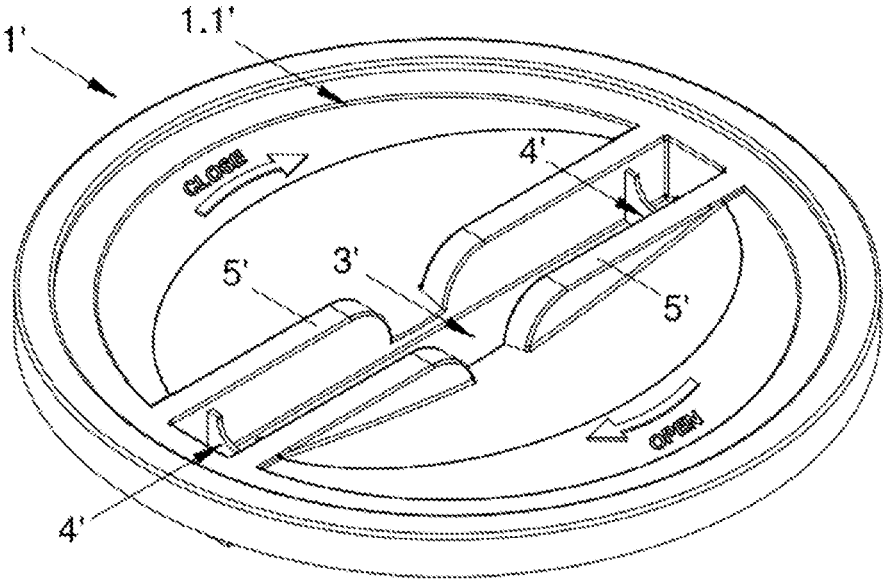
FIG. 6 shows a second version of the bucket lids in isometric and upper views.
Figure 7:
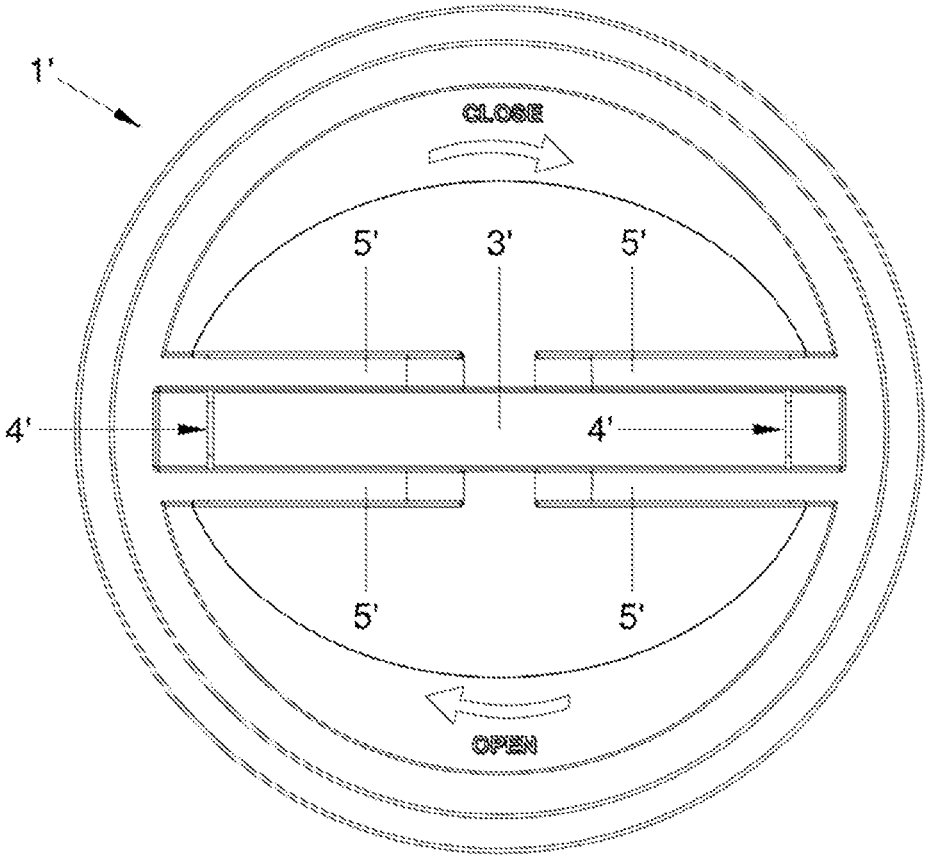
FIG. 7 shows a second version of the bucket lids in isometric and upper views
Figure 8:
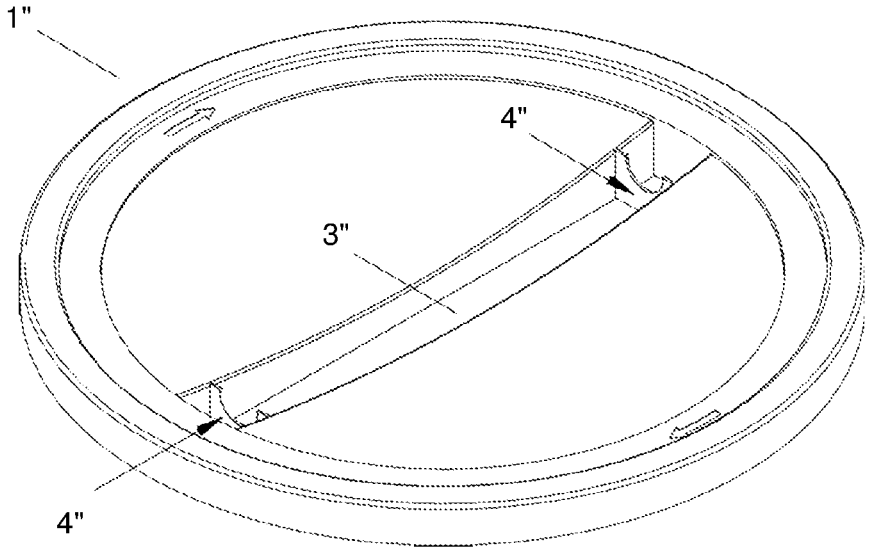
FIG. 8 shows a third version of the bucket lids in isometric and upper views.
Figure 9:
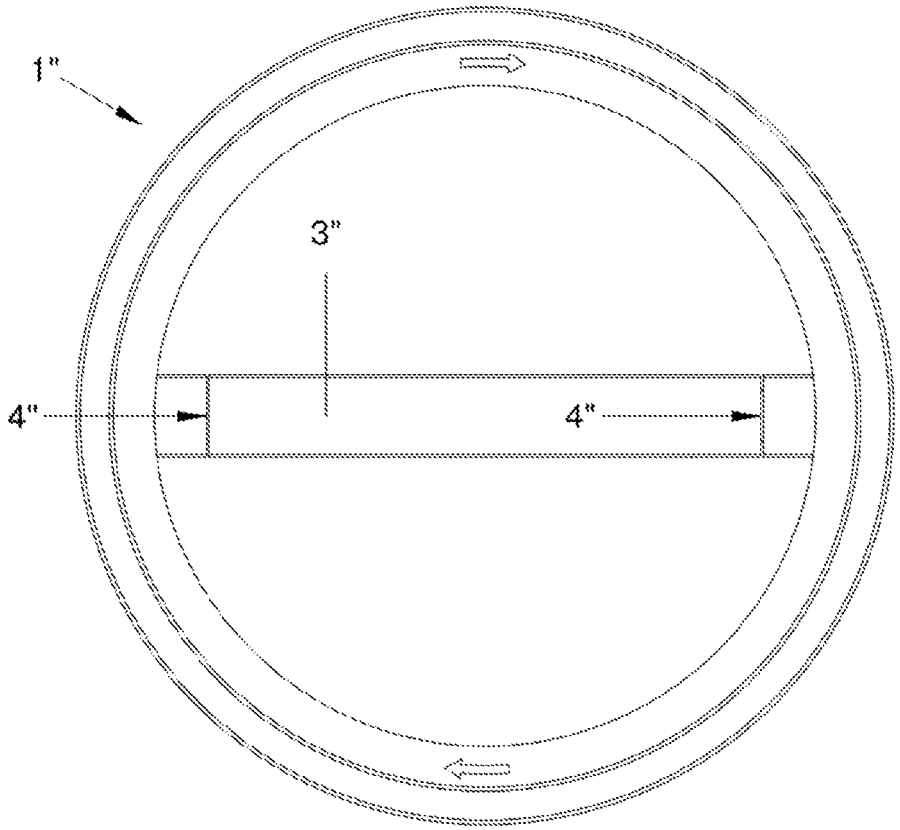
FIG. 9 shows a third version of the bucket lids in isometric and upper views.

A second version of the lid (1') (FIGS. 6 and 7) adopts the lid handles formed by shoulders (5') longitudinally to the central recess (3') which also holds the supports with semi-circular pressure fittings (4'), precisely in the same plane as their internal walls, starting said shoulders (5') near the central point of the central recess (3') and ending at the inner edge (1.1') of the lid (1');

Finally, a third version of the cover (1") (FIGS. 8 and 9) only includes the central recess (3") provided with the semi-circular pressure fittings (4") close to its ends, removing the handles/grips from the lid formed by shoulders (5) and (5').

The three models presented in the description above in the drawings are functional and do not interfere with known functionalities, such as the insertion of the lid into the bucket and the volume of the stored product. The choice of the lid model is at the discretion of the company, aimed at the standard that best meets their needs.

The main advantage of the proposed lid over the currently admitted ones is that it offers the solution to mix the product stored in the bucket immediately, eliminating recurring problems for most people, such as the problem of having to look for an object suitable for use in homogenization or not finding something similar to a stick in a timely manner, thereby preserving the integrity of the product due to the supply of own objects used for this purpose, dispensing with the use of objects contaminated with other products.

The current description of the invention must be understood as representative and not limiting, able to suffer modifications in its form, as long as such modifications do not escape the essence of the disclosure.

The invention claimed is:

1. A bucket cover assembly, comprising:

a stick having opposing ends and a perimeter edge;

a cover having a diameter;

a central recess formed in said cover, said central recess having a length that is up to 80% of said diameter of said cover;

supports with semi-circular pressure fittings disposed within said central recess, wherein said semi-circular pressure fittings selectively receive and retain said stick, therein joining said stick to said cover; and shoulders formed on said cover that are positioned longitudinally to the central recess, wherein said shoulders extend away from said central recess near a midpoint of the central recess toward said peripheral edge.

2. The assembly according to claim 1, wherein said stick is telescopic and equipped with a radially inserted ring.

3. The assembly according to claim 1, wherein said shoulders form handle/grips for said cover.

* * * * *